United States Patent [19]

Eckhaus

[11] Patent Number: 4,859,203

[45] Date of Patent: Aug. 22, 1989

[54] ELECTRICAL WIRE CONNECTORS

[76] Inventor: Ira Eckhaus, 1006 Neilson St., Far Rockaway, N.Y.

[21] Appl. No.: 99,351

[22] Filed: Sep. 21, 1987

Related U.S. Application Data

[63] Continuation-in-part of Ser. No. 864,435, May 16, 1986, Pat. No. 4,695,113, which is a continuation-in-part of Ser. No. 656,860, Oct. 2, 1984, abandoned.

[51] Int. Cl.[4] ..... H01R 4/24

[52] U.S. Cl. ..... 439/404

[58] Field of Search ..... 439/391–425; 174/84 R, 93; 340/531, 533, 545, 548

[56] References Cited

U.S. PATENT DOCUMENTS 2,738,479 3/1956 Gibson ..... 439/395

4,017,140 4/1977 Reavis, Jr. et al. ..... 439/408

*Primary Examiner*—Joseph H. McGlynn

*Attorney, Agent, or Firm*—Helfgott & Karas

[57] ABSTRACT

A quick connect electrical wire connector having a housing assembly with a base portion and a closure portion. The housing assembly receives an insulated electrical wire which is not stripped. The base portion is connected to another electrical member. A slicing mechanism is defined between the base portion and the closure portion for transversely slicing through the insulation so as to make electrical contact with the wire core therebeneath. Appropriate connection is provided for electrically connecting the slicing mechanism with the other electrical member. In this manner, closure of the closure portion onto the base portion permits electrical connection between the insulated electrical wire and the other electrical member. The device is provided with an adjustable mechanism so as to be able to accommodate wires of different gauge size with suitable adjustment being made to the device in order to accommodate such different gauge size wires.

3 Claims, 14 Drawing Sheets

622
630
634
632
624
608
610
618
634'
616
626
606
620
622'
605'
600
604
638
636
612
614
638'
602
752
752'
750
744
724
720
740
726
738
734
736
732
722
740
742
730
728
730
710
708
702
704
700
718
712
716
706
754
712
714

752
722
750
744
724
734
730
716
740
702
754
718
700

744
746
746
748
748

ELECTRICAL WIRE CONNECTORS

This application is a Continuation-In-Part application of Application Serial No. 864,435 filed May 16, 1986, now U.S. Pat. No. 4,695,113 issued September 22, 1987, which was a continuation-in-part of Application Serial No. 656,860 filed on October 2, 1984, now abandoned, all by the inventor of the present invention.

BACKGROUND OF THE INVENTION

This invention relates to electrical wire connectors, and more particularly to connectors of the "quick connect type", especially useful for burglar alarm systems.

Electrical connectors are typically required in order to couple together an electrical wire with another piece of electrical equipment. The other piece of electrical equipment can be another wire, metal foil, or electrical components. Typically, such electrical connectors include metal screws which can be loosened and to which is wound around a stripped metal wire so that the wire core will electrically contact the screws. The screws are then tightened. Other connectors can be crimped or soldered.

Certain types of electrical devices, such as electrical plugs now have what is commonly referred to as a "quick connect" arrangement. With such arrangements, the insulated wire is slipped into a channel and prongs pierce the electrical insulation to contact the wire core. While such arrangements are available for plugs and the like, their use has not been extended to wire connectors. Furthermore, the use of a prong is often sufficient to make satisfactory contact with the wire since the prong may miss the wire core. Also, in connection with coupling connectors, the prior art quick connect arrangement has not been useful for purposes of such connectors.

Electrical connectors are often used in conjunction with burglar alarm systems. In such systems, numerous types and styles of wire connectors are required depending upon the particular type of burglar alarm system installed. For example, when windows are foiled with metallic foil, the end of the foil must be interconnected to electrical wires which continue the burglar alarm system and provide a continuity within the house. Typically, terminal connector blocks are utilized for such purposes. With such blocks, in the prior art, the foil was connected to these terminal blocks and the wires were attached by means of the standard screw connection arrangement. At other locations in the typical burglar alarm system, one set of wires must be interconnected to another set by means of an easily separable wire connector which can pull apart. For example, such connectors are utilized on windows so that when the window will be open the connector will pull apart. Again, typically the screw connectors have been utilized where the insulated wires must be stripped and the wire core wrapped around the screws of the connector or a stripped wire is held in place by a screw exerting a force on a metal pin thereby exerting a holding force on the wire. Yet a third type of connector typically utilized in burglar alarm systems is the magnetic switch. In such cases, a pair of wires are held in place in a typically closed position by means of a magnetic reed switch included in the device and held in a closed position by means of an adjacent magnet. Should the magnet be removed by opening the window or door, for example, the wires will open by way of the magnetic switch causing the alarm to sound. Again, the wires have typically been connected by means of screws tightening onto the stripped wire.

While the foregoing has described typical connectors utilized in burglar alarm systems, it should be understood that connectors can also be utilized in other types of wiring systems, such as loud speaking systems, and other electrical installations. In all of these, typically for example, the wire connectors are of the crimp, solder and screw type where the stripped wires are wound around the screws and make contact by means of the tightened screws.

While all of the foregoing wire connectors utilizing the tightened screws for electrical contact have been adequate, they all require a considerable amount of time to connect the wire to the connector. When installing a burglar alarm system, by way of example,the amount of electrical connectors incorporated within such a system is such that any time spent on tightening electrical screws and making the connectors, adds to the installation time of the system and accordingly increases the cost of the system tremendously.

Accordingly, there is need for a series of electrical wire connectors which utilize a quick connect mechanism whereby the electrical insulation wire can be inserted without stripping the wire and without the need of a screw type connection to make contact with the electrical wire.

Additionally, often the user is not aware of the type of wire that may be utilized in the particular burglar alarm or other electrical system, in the past, any type of wire connector had to be specified to a particular wire size. If a thicker wire was utilized, a separately constructed wire connector was required. Generally, wire connectors had wire limitations of a very small range of size that could be accommodated. There was no way that the user was able to vary the wire connector to accommodate wires of different sizes.

Accordingly, there is a need for a series of electrical wire connectors which utilize the quick connect mechanism and which can further be varied so as to accommodate different wiring sizes.

SUMMARY OF THE INVENTION

Accordingly, it is an object of the present invention to provide electrical wire connectors which avoid the aforementioned problems of prior art devices.

Another object of the invention is to provide electrical wire connectors using a quick connect arrangement.

A further object of the present invention is to provide a series of electrical wire connectors of the quick connect type which can be utilized in conjunction with the installation of burglar alarm systems.

Still a further object of the present invention is to provide an electrical wire connector of the terminal block type which includes a quick connect arrangement and can be utilized for interconnecting metal foil to electrical wire.

A further object of the present invention is to provide an electrical wire connector having a male plug and female receptacle interconnecting two pairs of wires with the connectors being of the quick connect type.

Yet a further object of the present invention is to provide a magnetic reed switch permitting connection of a pair of wires in a quick connect arrangement.

Another object of the present invention is to provide an electrical wire connector where electrical wire can be connected to another electrical member without having to strip the electrical wire.

Still another object of the present invention is to provide an electrical wire connector of the quick connect type which makes contact to the wire core of an electrical insulated wire by slicing transversely through the insulation of the wire to make contact with the core.

A further object of the present invention is to provide an electrical wire connector which is easy to utilize, reduced in cost of manufacture, provides multiple uses, and can accommodate insulated wire without striping of the wire.

Briefly, in accordance with the present invention, there is provided an electrical wire connector having a housing assembly including a base portion and a closure portion. Receiving mechanisms associated with the housing assembly receive an insulated electrical wire to which electrical contact will be made. Associated with the base portion is a suitable coupling arrangement for connection to another electrical member. A slicing means is defined between the base portion and the closure portion for transversely slicing the insulation on the wire in order to make electrical contact with the wire core of the electrical wire.

The slicing means is electrically connected with the other electrical member. In this manner, upon closure of the closure portion onto the base portion, the insulation of the wire will be cut permitting electrical connection to be made between the wire core of the insulated wire and the other electrical member.

In an embodiment of the invention, the sliding means includes a metal tab with a substantially U-shaped notch formed in the tab. The notch includes an open mouth and a pair of opposing cutting edges. The width of at least a portion of the notch is less than the diameter of the wire core of the insulated electrical wire. A pressing mechanism is provided for forcing the insulated electrical wires into the notch by way of the mouth. In this way, the insulation is transversely sliced in order to electrically connect the wire core to the tab.

In an embodiment of the invention, the electrical connector defines a male plug and in conjunction with another wire connector which serves as the female receptacle, a connector assembly is provided. In this manner, a pair of electrical wires can be connected in a quick connect arrangement to the male plug, and another pair of electrical wires connected by means of a similar quick connect arrangement to the female receptacle. The male plug and female receptacle can then mate in order to make contact with the two pairs of wires.

In another embodiment of the invention, the wire connector defines a terminal block to which is connected a metal foil. The insulated electrical wire is connected to the terminal block by means of the quick connect arrangement so that an electrical connection can be made between the electrical foil and the electrical wire.

In yet another embodiment of the present invention, the wire connector defines a magnetic reed switch to which a pair of electrical wires can be connected by means of a quick connect arrangement. The reed switch itself is electrically connected within the device so that the wire core of the insulated electrical wires can be interconnected to the reed switch.

In all of the above arrangements, the quick connect of the wire is achieved by means of closing a closure member onto a base portion of a housing whereby the insulation is sliced transversely through in order to reach the wire core and make electrical contact thereto.

The present invention also provides for a slicing device which is capable of being adjusted so as to provide capability of slicing wires of different sizes. The slicing device is in the form of a cradle having an adjusting floating nut which supports a movable blade and matingly engages with a fixed blade. The spacing between the blades can be externally adjusted thereby accommodating wires of variable gauge sizes.

This slicing device can be inserted in various of the described embodiments. For example, it can be utilized in the male plug and female receptacle type of connector. It can also be utilized in the magnetic reed switch. In this manner, varied wire sizes can be utilized.

The aforementioned objects, features and advantages of the invention will, in part, be pointed out with particularity, and will, in part, become obvious from the following more detailed description of the invention, taken in conjunction with the accompanying drawings, which forms an integral part thereof.

Figures 19, 20, 21, 22:
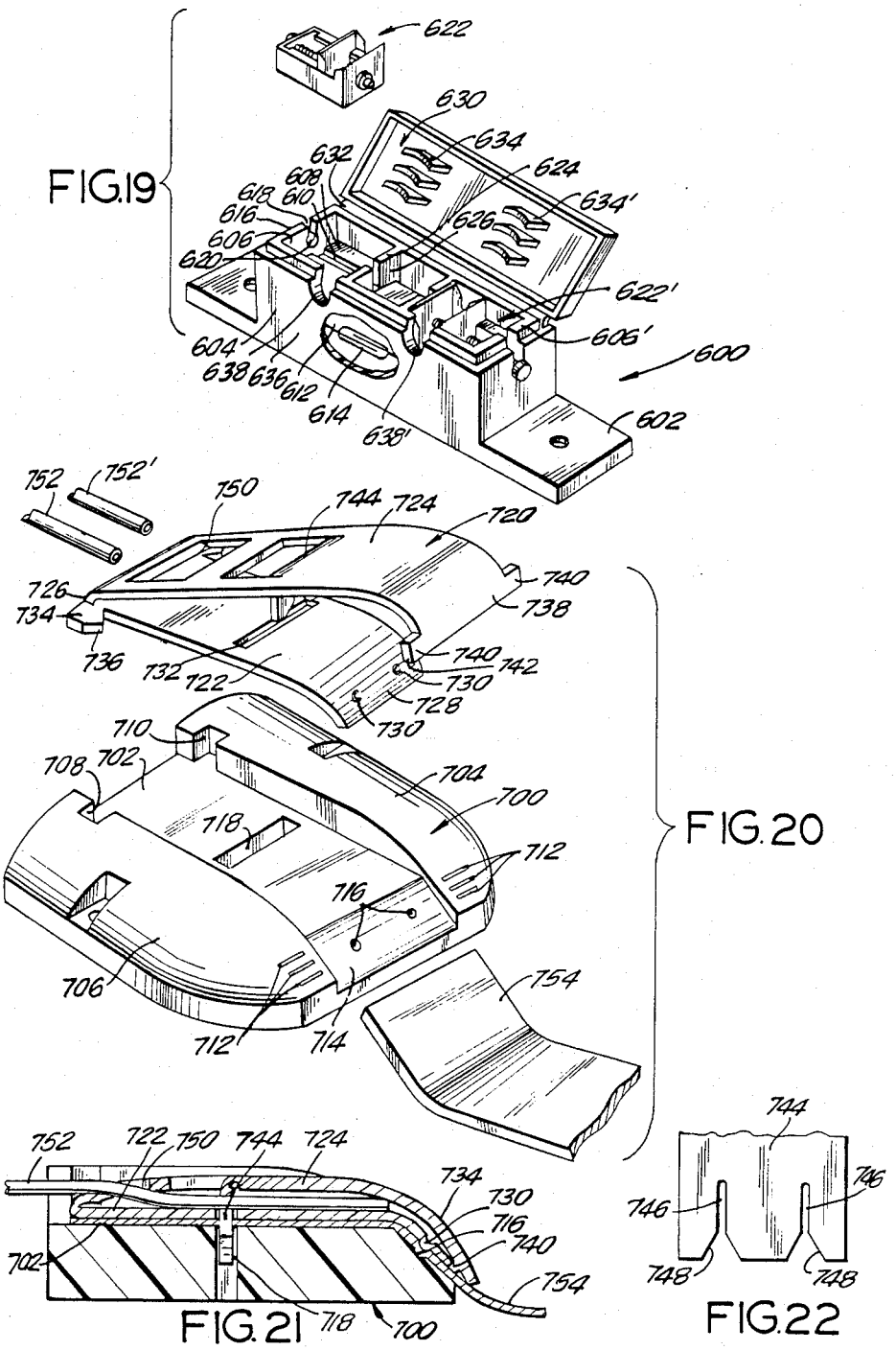
FIG. 19 is an exploded perspective view of a magnetic reed switch similar to that shown in FIG. 11 and utilizing the slicing cradles of FIGS. 15–17.
FIG. 20 is an exploded perspective view of another embodiment of a terminal block connector similar to that shown in FIG. 7.
FIG. 21 is a cross sectional view taken longitudinally through the center of the terminal block shown in FIG. 20 in the assembled condition.

FIGS .22 is an elevational view of the cutting blades utilized in the embodiment shown in FIG. 20

Figure 2:
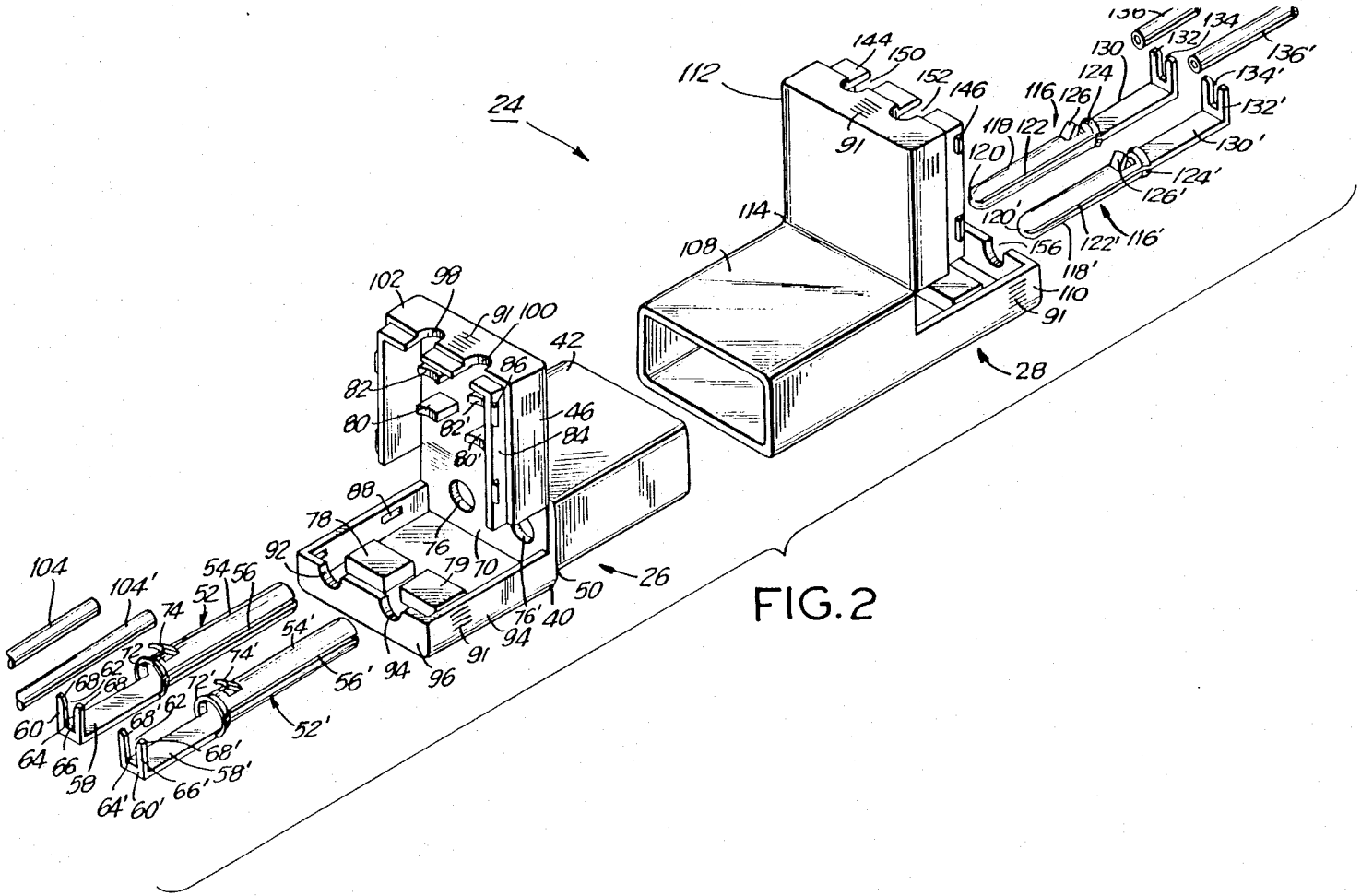
FIG. 2 is an exploded perspective view of one electrical connector of the present invention shown in the form of a male plug and a female receptacle including the quick connect arrangement of the present invention in both the plug and receptacle portions.
Figure 3:
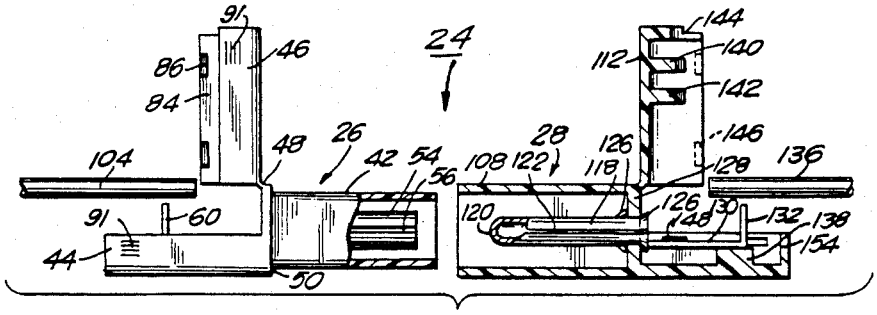
FIG. 3 is a longitudinal view through the male plug and female receptacle of FIG. 2, shown partially in cross section, with the plug and receptacle separated from each other.
Figure 7:
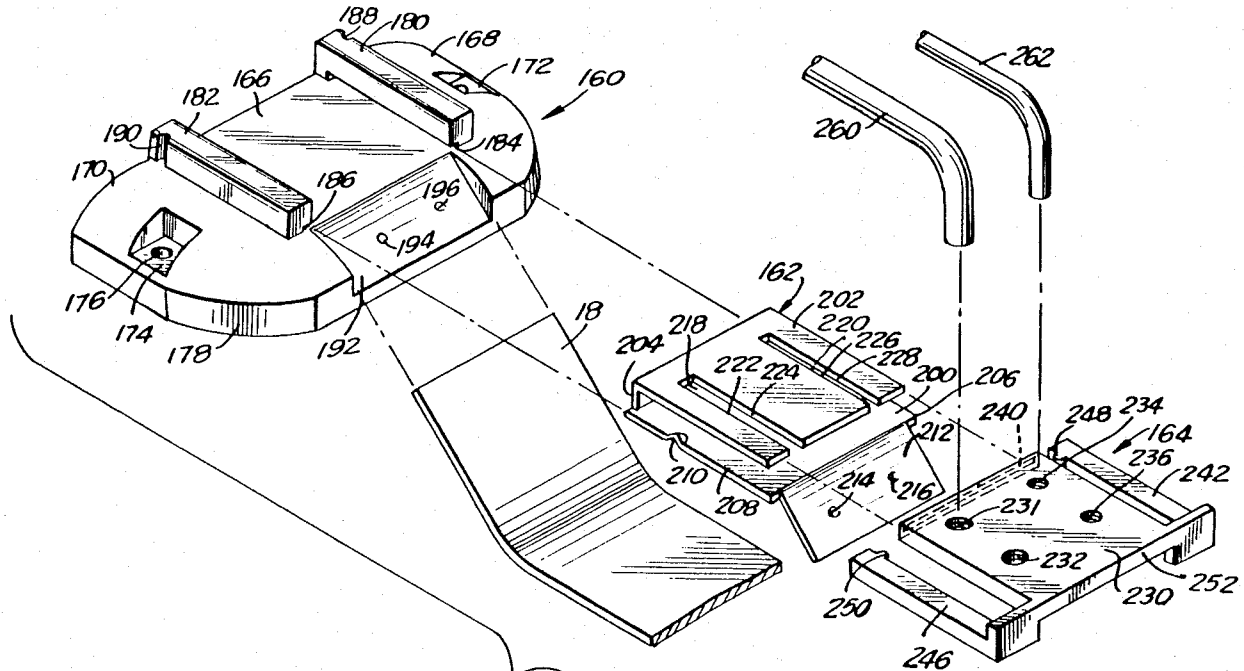
FIG. 7 is an exploded perspective view of another embodiment of the wire connector of the present invention shown as a terminal block to which is connected a metal foil and electrical wire.
Figure 11:
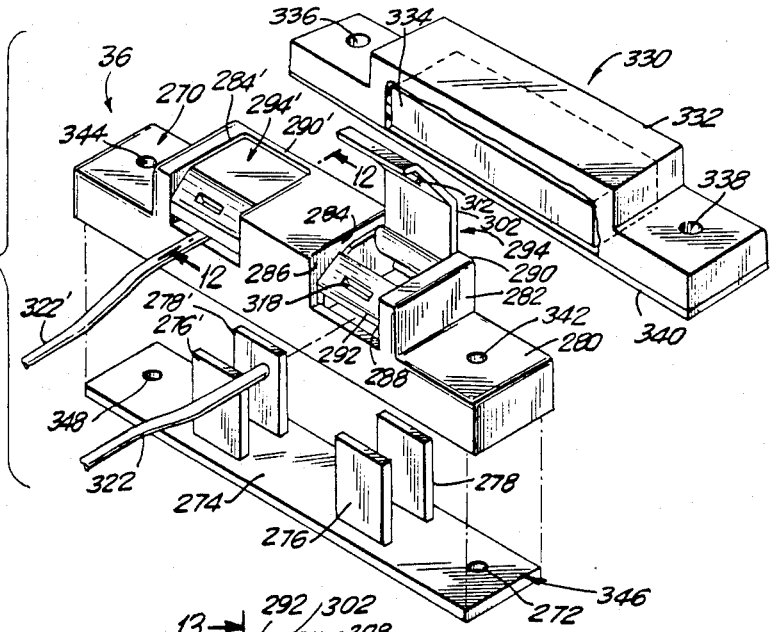
FIG. 11 is an exploded perspective view of yet another embodiment of the wire connector of the present invention and specifically shown as a magnetic reed switch.
Figure 12:
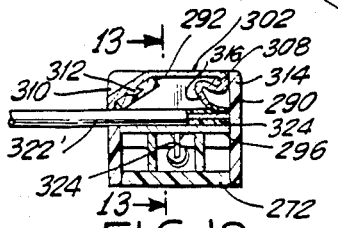
FIG. 12 is a cross sectional view taken along lines 12—12 of FIG. 11.
Figure 13:
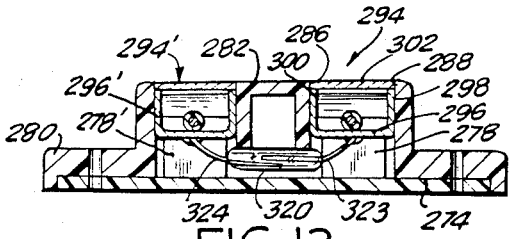
FIG. 13 is a cross sectional view taken along lines 13—13 of FIG. 12.
Figure 18:
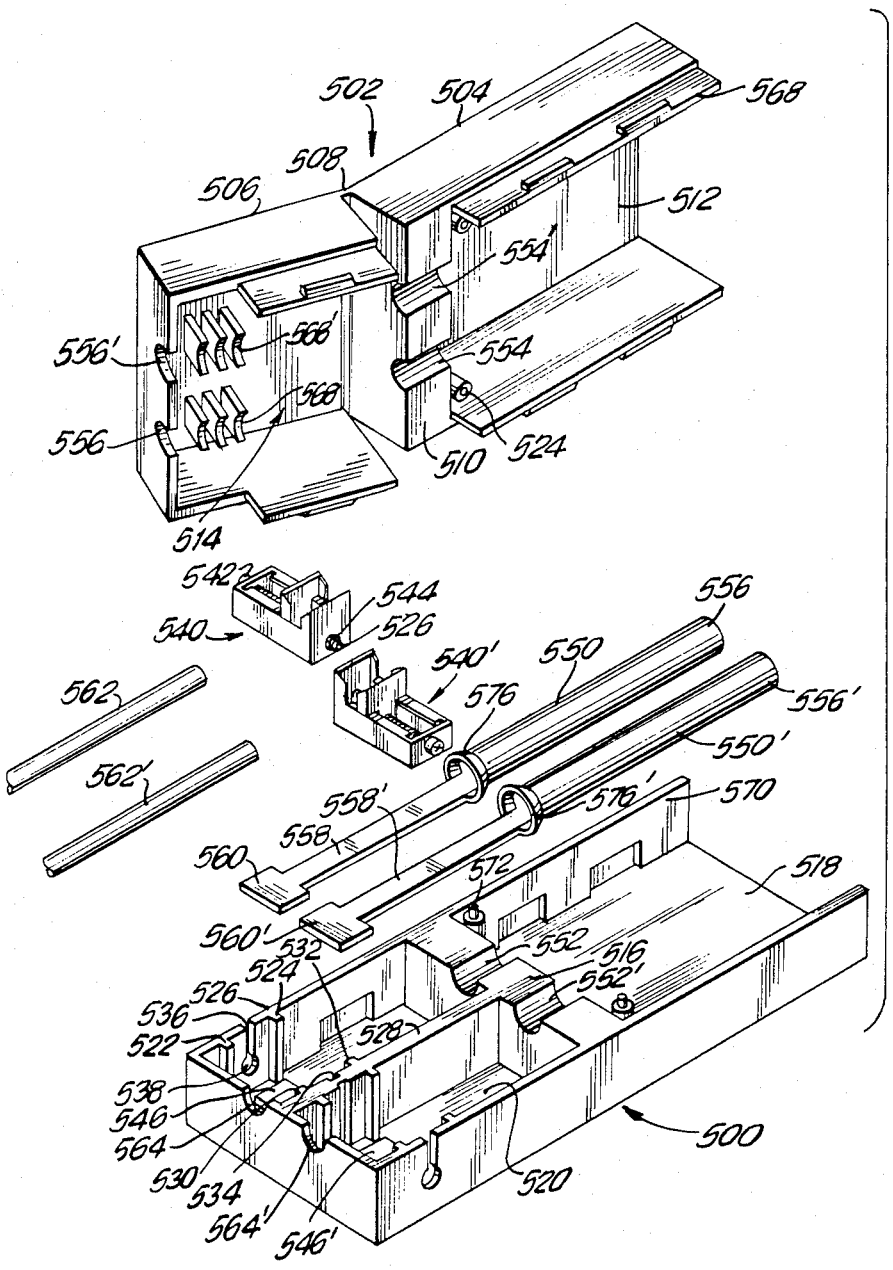
FIG. 18 is an exploded perspective view of an electrical connector similar to that shown in FIG. 2 and shown in the form of a male plug including a quick connect arrangement utilizing the slicing cradle shown in FIGS. 15–17.
Figure 23:
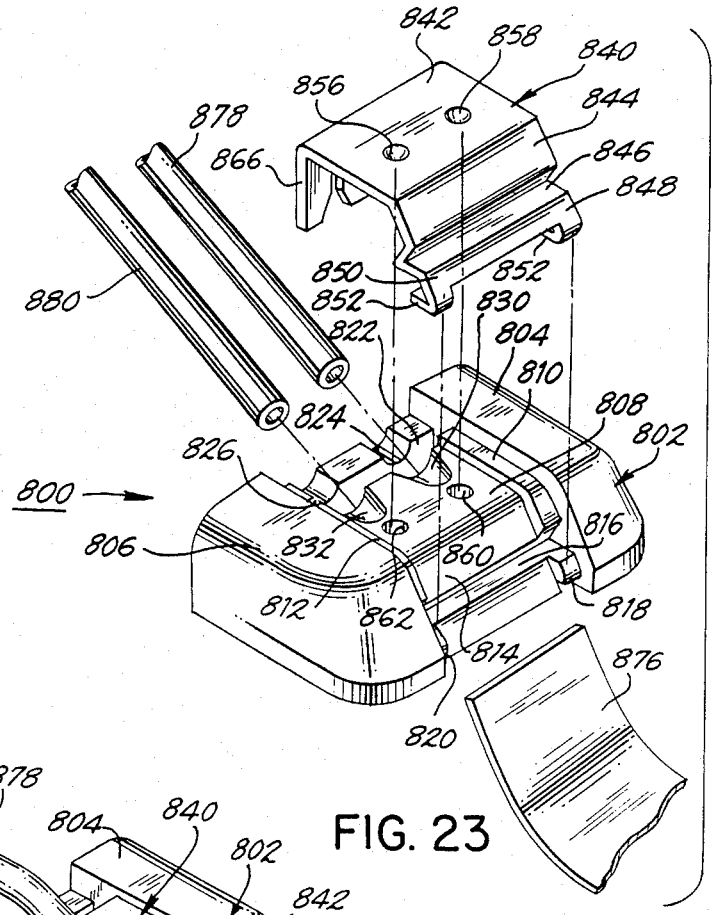
Figure 24:
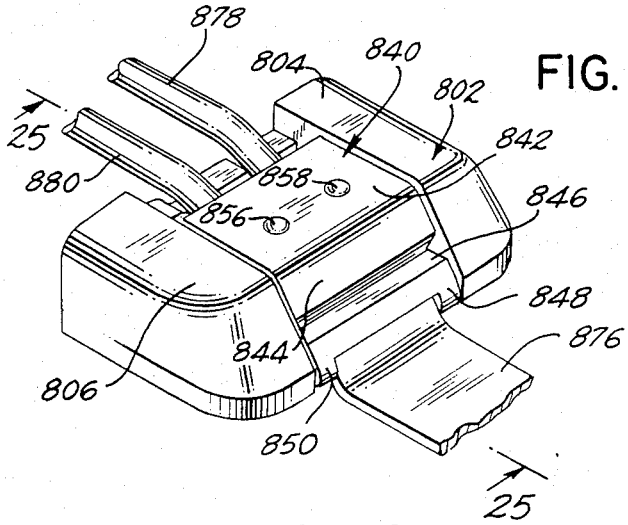
Figure 25:
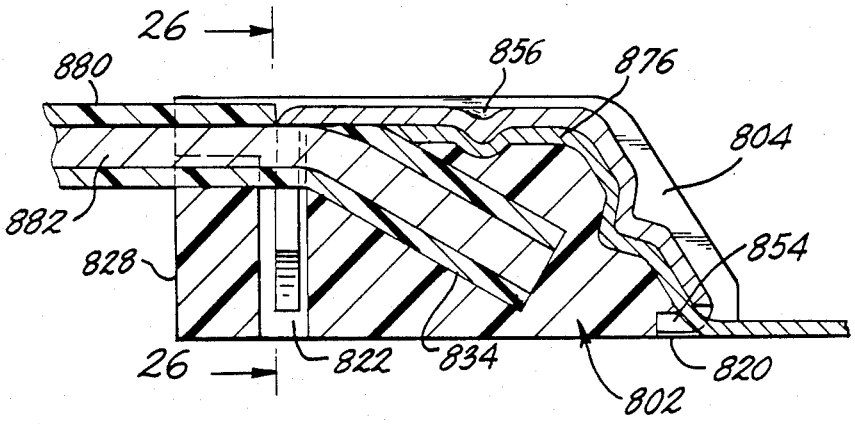
Figure 26:
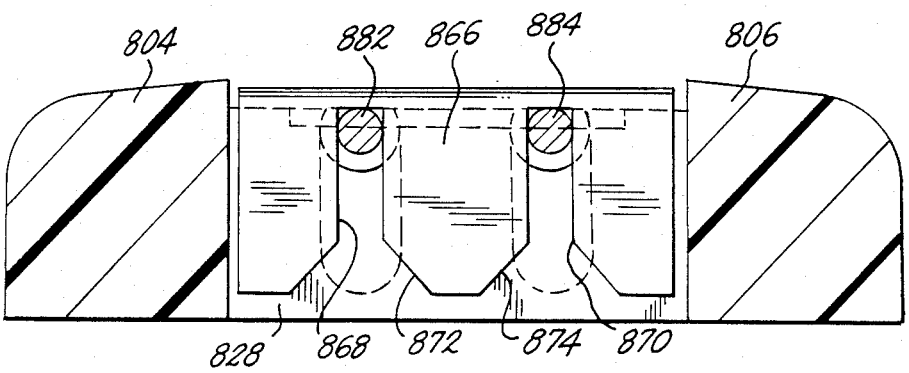
Figure 27:
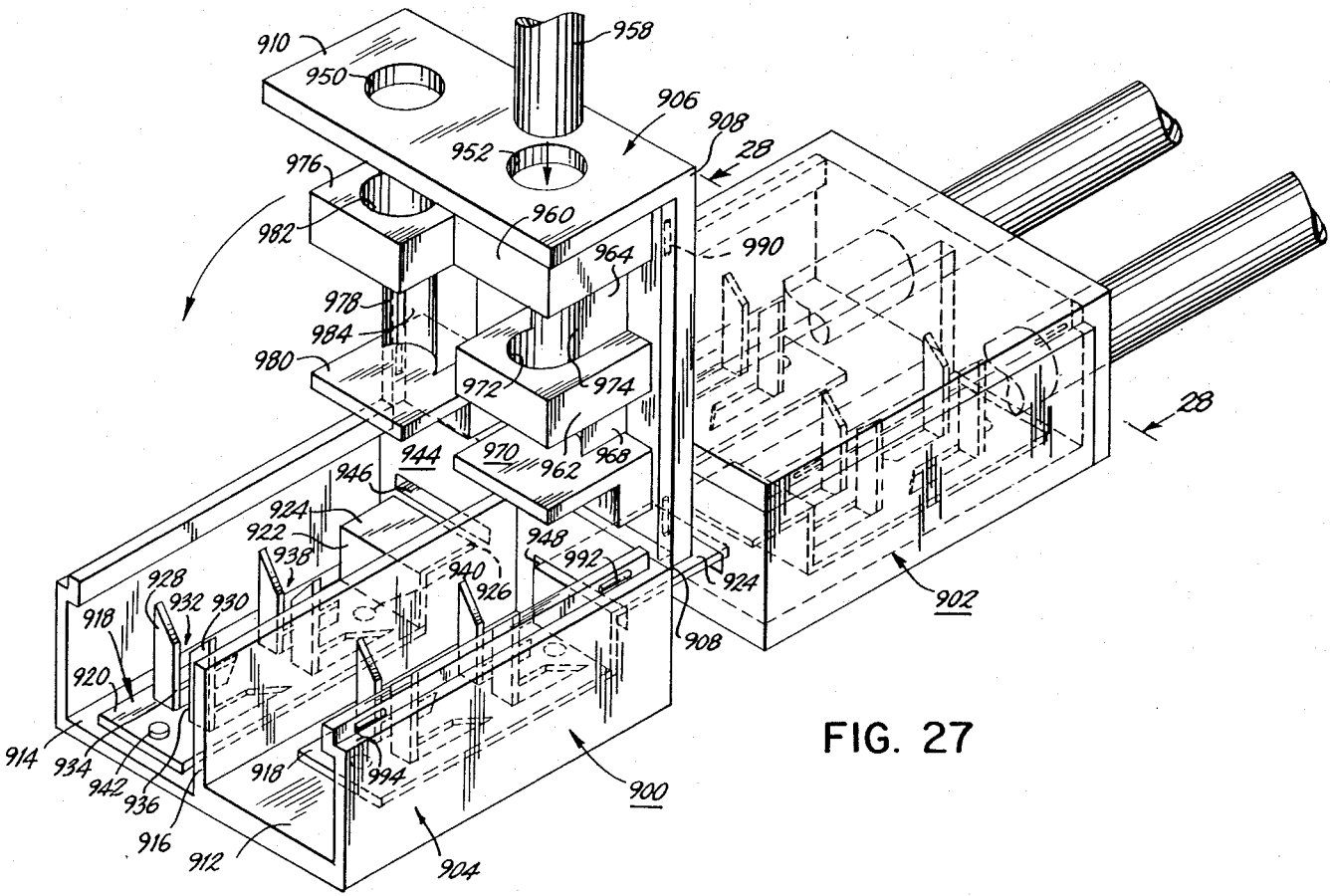
Figure 28:
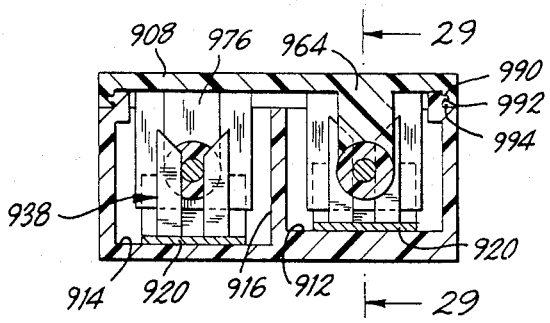
Figure 29:
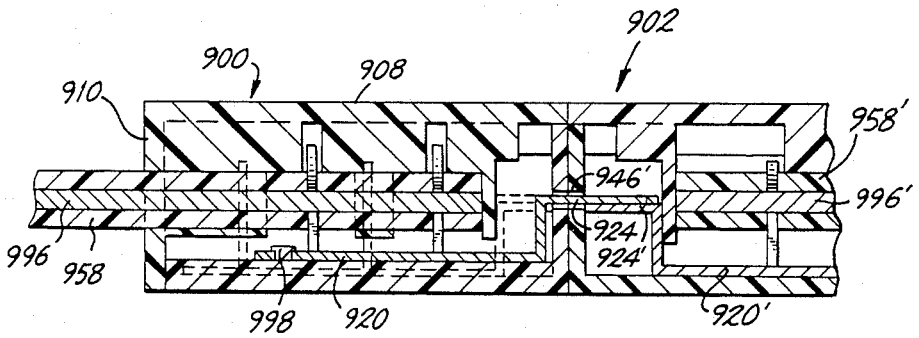
Figure 30:
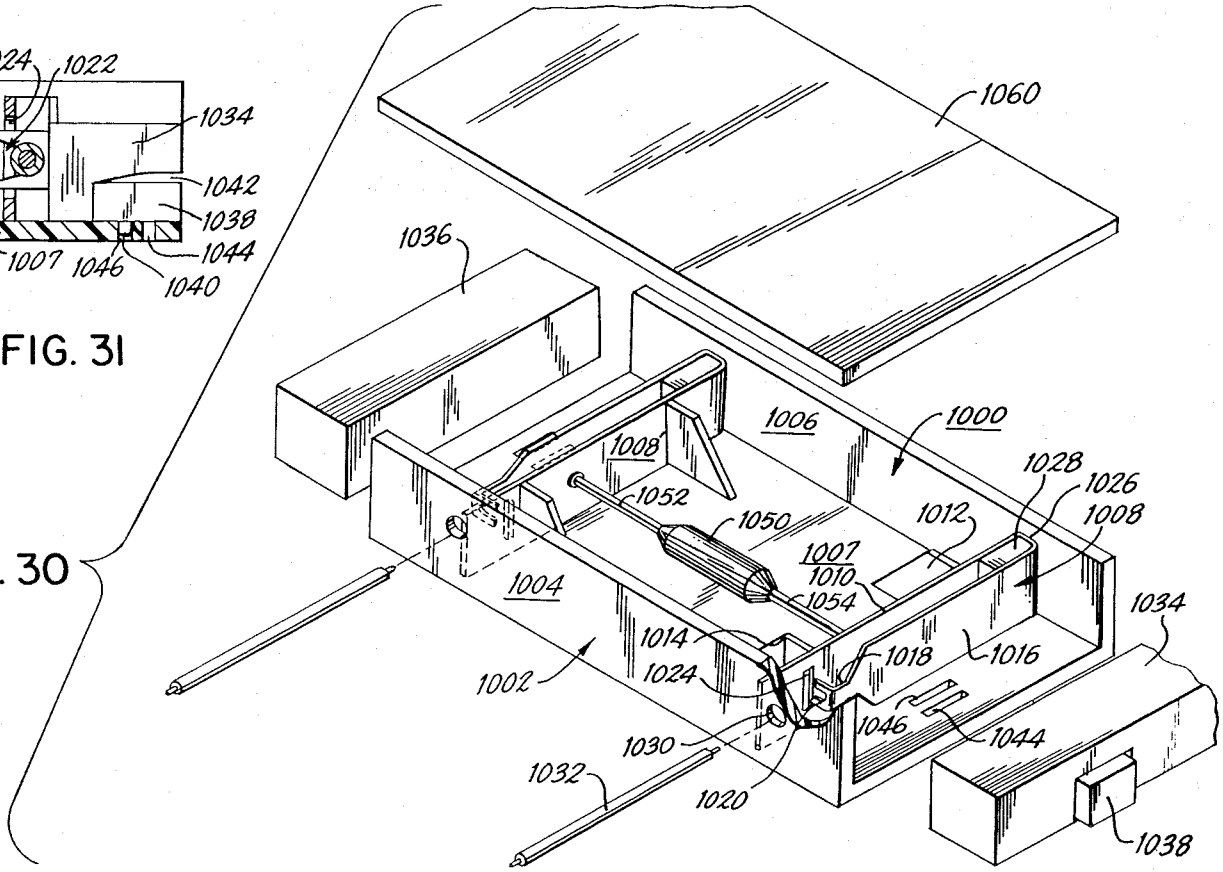
Figure 31:
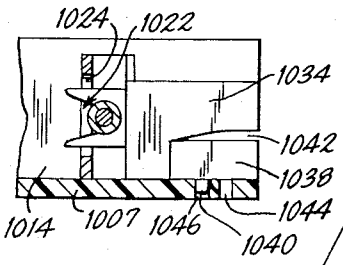

FIG. 23 is an exploded perspective view of another embodiment of a terminal foil block connector similar to that shown FIGS. 7 and 20;

FIG. 24 is a perspective view of the embodiment shown in FIG. 23, and specifically showing the terminal block connector in an assembled condition;

FIG. 25 is a cross-sectional view taken along lines 25—25 of FIG. 24;

FIG. 26 is a cross-sectional view taken along lines 26—26 of FIG. 25;

FIG. 27 is an exploded perspective view of another embodiment of a plug type connector similar to that shown in FIG. 2, and FIG. 18;

FIG. 28 is a cross-sectional view taken along line 28—28 of FIG. 27;

FIG. 29 is a cross sectional view taken along lines 29—29 of FIG. 29;

FIG. 30 is a perspective exploded view of another embodiment of a magnetic read switch similar to that shown in FIG. 11 and FIG. 19; and FIG. 31 is a partial sectional view through an edge of the magnetic read switch of FIG. 30 and showing the splicing of the wire in making an electrical connection.

In the various figures of the drawing like reference characters designate like parts.

DESCRIPTION OF THE PREFERRED EMBODIMENTS

The present invention relates to electrical wire connectors of the quick connect type which has a slicing means which slices through the insulation of an insulated wire in order to make contact with the wire core. Such electrical connectors find multiple uses in various electrical systems. However, as means of explaining a typical use of the wire connectors, reference will hereinafter be made to a burglar alarm system which includes various types of electrical connectors.

Figure 1:
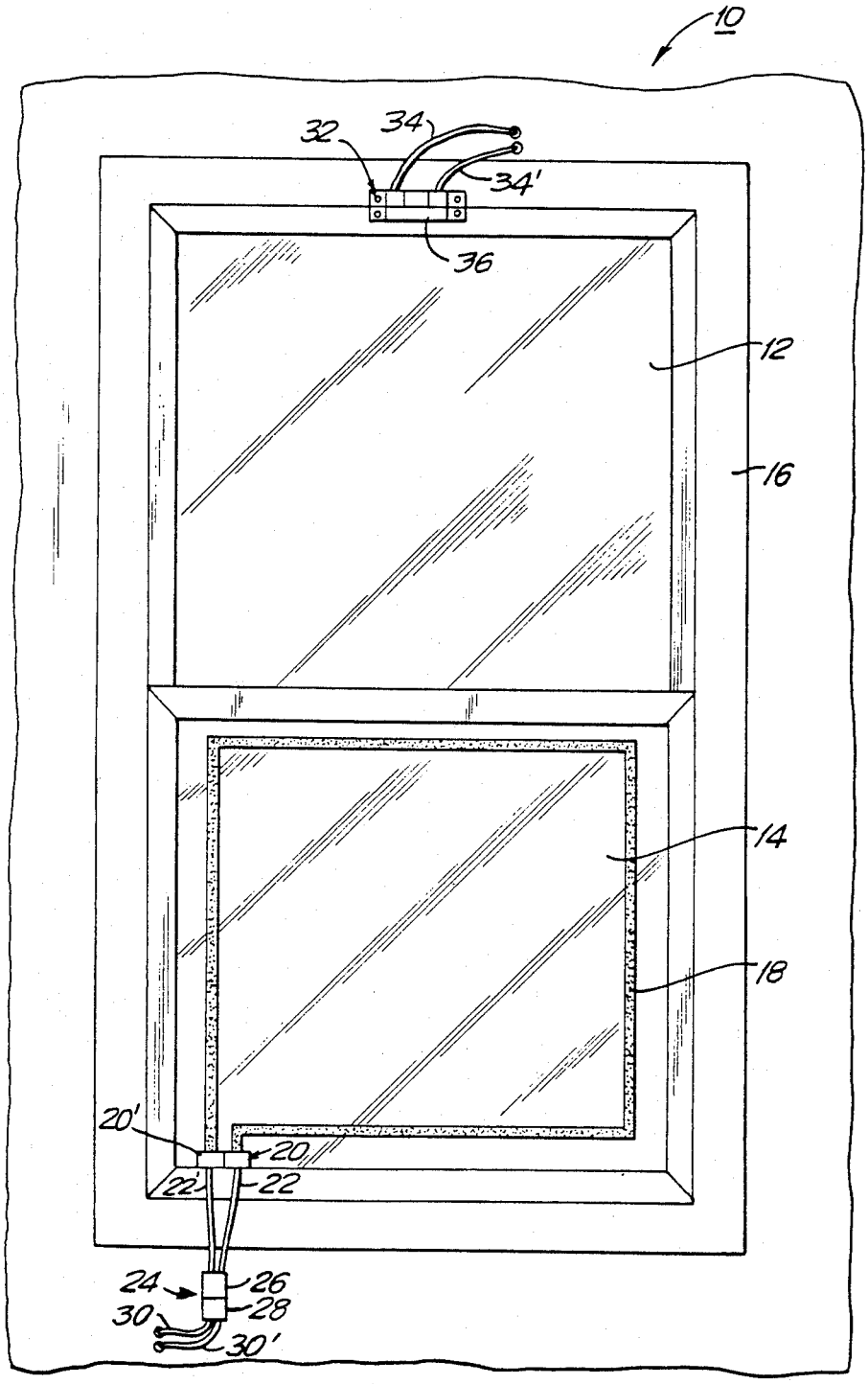
FIG. 1 is an elevational view of a window assembly including a burglar alarm system in which are incorporated three types of electrical wire connectors of the type including the quick connect arrangement of the present invention.

Referring now to FIG. 1 there is shown a window assembly 10 including an upper window 12 and a lower window 14 held in a window frame 16. In order to include such window in a burglar alarm system, numerous methods can be utilized. One method is to provide a metal foil around the window and include the metal foil within the continuous burglar alarm wired path. Should the window be broken, the foil will be split which will open the burglar alarm system causing the alarm to sound.

As shown in FIG. 1, the lower window 14 is foiled by means of the metal foil 18 foiled around the periphery of the window. At the edge of the window the metal foil is interconnected to the rest of the systems by means of terminal blocks 20 and 20′, both of which are substantially identical. The metal foil interconnects to the terminal block 20, and an electrical wire 22, 22′ would also interconnect to the terminal blocks.

Another type of electrical connector which can typically be utilized within a burglar alarm system is shown generally as the connector assembly 24. In this type of connection, a pair of wires 22, 22′ would be interconnected to one-half of the assembly 26, which can typically be the male plug. The other half of the connector assembly 28 would constitute a female receptacle to which is connected another pair of wires 30, 30′. With this type of connector, the male and female portions can easily separate. As a result, if someone should open the lower window 14, he would separate the male and female portions thereby opening the burglar alarm system causing the alarm to sound.

Another type of electrical connector utilized in burglar alarm systems is a magnetic reed switch. As shown in FIG. 1, the upper window 12 is protected by such a magnetic reed switch shown generally at 32. A pair of wires 34, 34′ are electrically connected to the magnetic reed switch 32. Within the housing of the magnetic reed switch would be a switch portion which is held in a closed position by means of the magnet 36. The magnet 36 would be retained on the window portion while the magnetic reed switch 32 would be attached to the frame portion 16. Should the window 12 be lowered, it would remove the magnet from the reed switch thereby permitting the magnetic reed switch to open thereby opening the electrical circuit of the burglar alarm causing the alarm to sound.

Each of the three types of wire connectors 20, 24, 32 have been utilized in the prior art but required in the prior art the use of metal screws for connecting the wire. Furthermore, the wire had to be stripped before it could be connected to the metal screws of these connectors. As a result, installing the burglar alarm system required considerable time and effort and thereby increased the cost of installing such a system. As will hereinafter be described, these switches can now be provided with quick connect mechanism wherein the wire can be inserted without stripping. The entire insulated wire is inserted within each of these wire connectors and by means of a closure member closing onto the insulated wire the wire will be sliced so that the insulation portion will be sliced through and contact will be made directly to the wire core in the wire. This will avoid the necessity of stripping the wires and opening and closing of screw portions.

Referring now to FIG. 2–6, there is shown the connector assembly 24 including the male plug 26 and the female receptacle 28. The male plug is formed of a substantially rectangular body 40 having a forward rectangular coupling portion 42 and a rear substantially rectangular receiving portion 44. The rear is split so that the upper half 46 can pivot about an integral hinge 48 and move between a raised position shown in FIG. 3 and a closed position shown in FIG. 4. The forward coupling portion 42 has a slightly reduced periphery from the rear receiving portion 44 and is separated therebetween by means of the shoulder portion 50 about its periphery.

A pair of female pins shown generally at 52 and 52' are inserted within the male portion. The pins include a tubular forward portion 54, 54' which can be rolled together meeting at the seam 56, 56'. Extending rearward from the tubular portion is a substantially flat receiving arm 58, 58' terminating in an upwardly extending tab 60, 60' at its distal end. The tab itself is bifurcated to form a U-shaped notch 62, 62'. The opposing walls of the notch 64, 64' and 66, 66' form a pair of cutting edges. The upper ends of the notch at its mouth portion are rounded at 68, 68'.

The female pins 52, 52' are inserted into the male plug so that the tubular portion extends forward of a separating wall 70 formed in the male plug and separating the forward coupling portion 42 from the rearward receiving portion 44. In order to retain the female pins 52, 52' in place the medial edge of the tubular portions 54, 54' are outwardly flared at 72, 72' so as to remain secured on the rearward side of the separation wall 70. Forward of the separation wall, at least one prong 74, 74' is upwardly struck on a rearwardly facing direction from the tubular portion 54, 54'. The prong 74, 74' will hold the pins 52, 52' in position in front of the separation wall 70. As a result, the pins 52, 52' can be inserted by pressing from the rearward through the pair of holes 76, 76' provided in the separation wall 70 and the prongs 74, 74' will pass through the holes 76, 76' until inserted and then will be held in place. Adjacent platform sections 78, 79 are formed transversely across the bottom of the receiving body 44 so as to respectively support the arms 58, 58' of the pins 52, 52'.

Downwardly depending from the inner surface of the cover 46 are provided a first pair of depressing fingers 80, 82 which can straddle the tab 60, and a second pair of depressing fingers 80, 80' which can straddle upwardly the extending tab 64'. The lower surfaces of these fingers are arcuately shaped so as to matingly confront the circumference of an insulated wire placed therebeneath.

Figure 6:
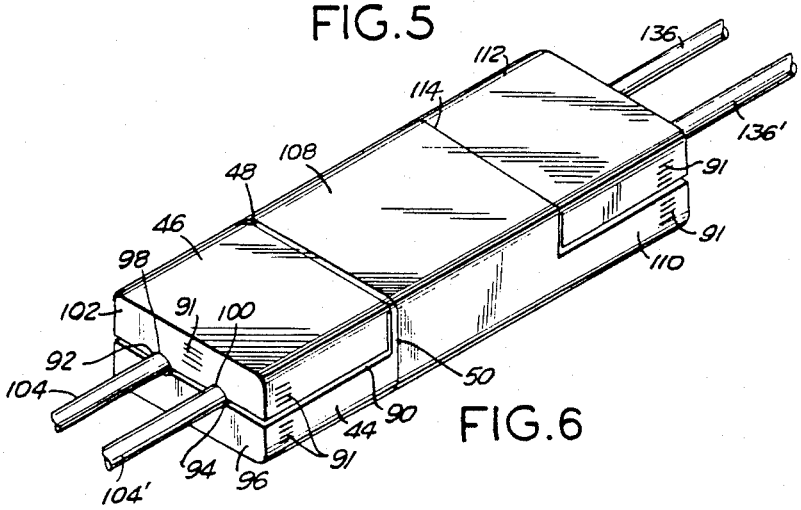
FIG. 6 is a perspective view of the assembled male plug and female receptacle shown in FIG. 2.

In order to lock the cover 46 in place, a depending indented skirt portion 84 is provided around the periphery of the cover 46 from which project locking tabs 86 for locking into indents 88 matingly provided around the periphery of the inside wall of the receiving body 44. When closed, the locking tabs 86 are positioned so as to provide a slight space 90, as shown in FIG. 6, in which can be inserted a screwdriver, coin, or the like, and possibly with fingers to lift up the cover 46 from the lower receiving portion 44 in order to open the receiving body portion. Thumbnail grooves 91 are also provided on the various parts to facilitate grasping in order to open the parts.

The bottom halves of a pair of receiving holes 92, 94 are provided in the rear wall 96 of the receiving body portion 44. Correspondingly mating portions 98, 100 are provided in the rear wall 102 of the cover portion. Together these hole sections combine to provide a complete receiving hole for insulated wires 104, 104'.

Figure 4:
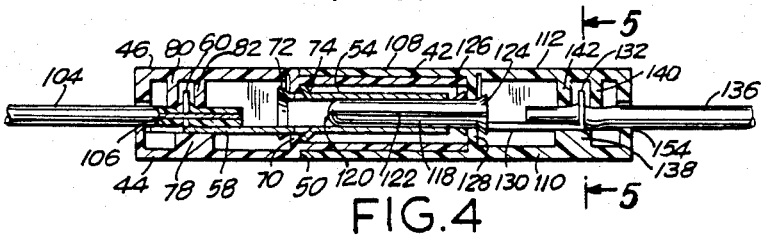
FIG. 4 is a cross sectional longitudinal view similar to that shown in FIG. 3 and showing the male plug inserted with the female receptacle.

To assemble, the cover portion 46 is lifted up from the bottom receiving portion 44. The insulated wires 104, 104' are inserted across the bottom portions 92, 94 of the receiving holes and are placed across the mouth of the bifurcated U-shaped notches 62, 62'. The wires need not be pressed down into the notches but simply placed at the mouths thereof. The cover 46 is then closed onto the wires. The depressing fingers 80, 82 and 80', 82' will force the wires into the notches, as shown in FIG. 4, whereby the opposing cutting edges 64, 64' and 66, 66' will slice through the insulation transversely on either side of the wire core 106 so as to permit electrical contact to be made between the wire core 106, of the wire 104 and the female pins 52, 52'. The cover is then locked in place and will remain secure. The wire will be held in place by means of the receiving holes which are of substantially the same size as the wire so that they hold them tightly in place. Also, they will be held in place within the U-shaped notches in the tabs.

The female receptacle 28 is similar to the male plug 26 heretofore described. Accordingly, it will only be briefly described hereinafter. Specifically, it also includes a forward coupling portion 108 and a rearward receiving portion 110 with a cover portion 112 pivotally connected by means of the integral hinge 114. It should be noted that on the female receptacle portion, the body is uniform rectangular throughout. In this manner, since the forward coupling portion 42 of the male plug had a reduced periphery, the male plug will be telescopically insertable into the female coupling portion 108, as shown in FIG. 4. The male portion can be inserted up to its shoulder 50. In this manner, when coupled together, as shown in FIG. 6, a uniform rectangular block shape is formed throughout in order to provide an aesthetically acceptable coupling connector assembly.

A pair of male pins 116, 116' are provided in the female member 28. The male pins 116, 116' are substantially identical to the female pins 52, 52' heretofore described except that the male pins 116, 116' have a smaller tubular diameter to their tubular forward portions 118, 118'. Also, the forward ends form a closed bullet tip 120, 120'. As a result the male tubular portions 118, 118' can be inserted into the female tubular portions 54, 54' to provide electrical contact therebetween, as shown in FIG. 4.

The male pins can also be formed by rolling material to form a seam 122, 122'. An outwardly flared portion 124, 124' is provided at the medial end and an upwardly struck prong or prongs 126, 126' is also provided. The flared portions 124, 124' and the prongs 126, 126' will be positioned on either side of the separating wall 128.

The receiving arm 130, 130' extend from the tubular portion and again terminates in the upwardly extending tabs 132, 132' in which are formed the U-shaped notch portions 134, 134'. The side edges of the notches form cutting edges for slicing through the insulation of the wires 136, 136'.

With the male pins inserted into the female receptacle the arm portions 130, 130' will be supported by means of the platform 138 form in the receiving section 110. The depending fingers 140, 142 will depend from the cover portion 112 of the female receptacle so as to press down onto the wire 136 and force it into the U-shaped notch of the tab portion 132. The skirt portion 144 around the periphery of the cover portion 132 is also provided with the locking tabs 146 mating into the appropriate indents 148 to lock the cover in place. Appropriate receiving holes 150, 152 in the cover portion mate with the corresponding hole portions 154, 156 in the bottom receiving body portion 110 to form a tight hole for receiving the wire 136.

Figure 5:
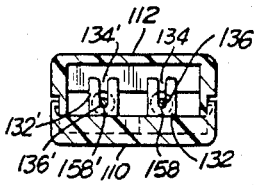
FIG. 5 is a cross sectional view taken along lines 5—5 of FIG. 4.

The wires 136, 136' can be placed on the respective notches 134, 134' and with the cover 112 lowered onto the bottom receiving portion 110, the depending fingers 140, 142 will force the wires into the notches to slice through the insulation on the wires. The wire cores 158,

158' in FIG. 5 will make contact with the tabs so as to permit electrical contact therewith.

In this manner, both the female and male portions can be quickly connected without having to strip the wires and without having to open and close any screws. Once the pair of wires are connected to the male plug and a separate set of wires connected to the female receptacle, the male plug can be simply inserted into the female receptacle. The male pins in the female receptacle will then be inserted into the female pins in the male plug so as to make electrical contact therewith.

It should be noted, that by placing the male pin in the female receptacle and a female pin in the male plug, extra rigidity is provided between the connection. In this manner although the two parts can be easily pulled apart in order to permit breaking of the burglar alarm system should an unauthorized entry occur, at the same time when the two components are interfitted matingly together, they provide a secure rigid connection.

The terminal block 20 shown in FIG. 1 will now be described in more detail with reference to FIGS. 7–10. The terminal block comprises three sections shown generally at 160, 162, 164. The base member 160 includes a substantially flat lower level 166 having downwardly curved side shoulder portions 168, 170. A pair of opposed notched cutouts 172, 174 are formed with mounting bores 176 formed therein. This will permit mounting to the terminal block by means of screws or nails, should such be desired. At the same time, on the base wall 178 there can be included adhesive tape for easy stick of the terminal block on to a surface.

On either side of the lower wall 166 are provided a pair of opposing raised walls 180, 182. At the lower inner edge of the wall, where the walls 180, 182 join the lower surface 166 there is provided an undercut portion 184, 186 which extends beneath the walls 180, 182 commencing from the forward edge of the walls and terminating in a spaced distanced from the rear. A pair of vertical grooves 188, 190 are formed into the outer surfaces of the walls 180, 182 adjacent the rear ends thereof. The forward end of the lower wall 166 terminates in a downward sloped surface 192 on which there are provided indents 194, 196.

The contact metallic section 162 is formed of substantially U-shaped configuration including a lower wall 200 and an upper wall 202 spaced by a rear connecting wall 204. The lower wall 200 has a width slightly greater than the upper wall 202 so as to include the lateral edges 206, 208. A pair of upwardly projecting prongs 210 are provided along the lateral edges 206, 208. The lower wall 200 terminates in a downwardly extending forward wall 212 which is commensurate with the forward wall 192 on the base portion 160. A pair of detents 214, 216 are provided for mating into the indents 194, 196 on the wall 192.

In the upper wall 202 there are provided two U-shaped channels 218, 220. The channels each have a pair of side walls 222, 224, and 226, 228 which form a pair of opposing cutting edges. The U-shaped channels are shown of different sizes and the size of the channel is such as to be of substantially the same size as the wire core of the insulated wire that will be inserted therein.

The closure member 164 includes a main body portion 230. Two pairs of parallel holes 231, 232, 234, 236 are formed transversely therethrough. The main body portion 230 is hollow and includes the open mouth 240 at its rear. Laterally, positioned on either side of the main body portion 230 are shown the lateral wing portions 242, 244. At the distal ends of the wing portion 242, 244 there are included inwardly projecting fingers 248, 250 for engaging into the grooves 188–190 of the base portion 160. The front wall 252 of the closure member 164 extends entirely across both the main body portion 230 and the lateral portions 242, 246.

Figure 10:
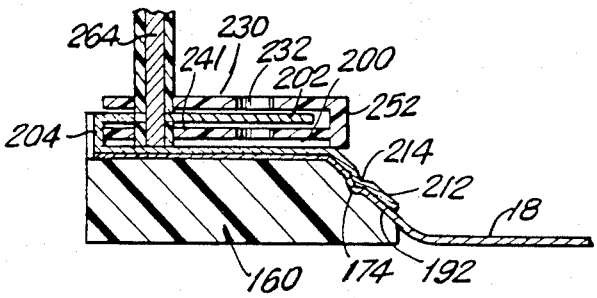
FIG. 10 is a cross sectional view taken along lines 10—10 of FIG. 9.

In assembling the device, a metal foil 18 which can be the edge of the foil around the window, is placed up and onto the ramp 192 and on the lower surface 166. The metal contact portion 162 is then slid in place so that the lateral portions 206, 208 are received in the undercut channels 184, 186. The contact member will be held in place by means of the upward prongs 210 which will provide a tight fit within the channels. In placing the contact member in place the detent 214, 216 will bite into the metal foil and push it into the indents 194, 196. As shown in FIG. 10 in order to make electrical contact between the downward sloped portion 212 and the metal foil.

One or more wires 260, 262 are inserted into a corresponding ones of the holes 231, 232, 234, 236. Although only one wire would be needed to make electrical contact, it is frequently desired to use the terminal blocks for interconnection of various types of wires. Some of these wires may be of different sizes. It should be noted, that the holes 231, 232 are the size substantially corresponding to the diameter of a thicker wire 260. The holes 234, 236 are smaller and correspond to the wire size of a smaller wire 262. Two of each of the wires can be provided. It should be understood, however that by means of additional holes, different size and numbers of wires can be included.

It should be appreciated, that the wires are inserted with their insulation intact without having them stripped.

With the wires inserted in the corresponding holes of the closure member 164, the closure member is slid onto the subassembly. Specifically, the upper plate 202 of the contact member 162 is received within the mouth 240. Forcing the closure member onto the upper plate 202 forces the wires 260, 262 into the corresponding U-shaped notches 218, 220 whereby the cutting edges 222, 224 will transversely slice the insulation on the wire 260 making contact with the metal wire core 264 therein. Similarly the cutting edges 226, 228 will transversely slice through the insulation of the wire 262 making contact with the wore core therein.

Continued pressure will place the upper wall 202 sandwiched between the upper part 230 and the lower part 241 of the closure member 164 until the wires are fully in place. The inwardly projecting fingers 248, 250 will the snap in place on the grooves 188, 190 of the sidewalls 180, 182 to hold the closure member in place.

It should be appreciated, that the back wall 204 of the contact member does not go all the way to the rear of the base member, as best seen in FIG. 10. In this manner, should there be additional metal foil adjacent the terminal block, there will not be a shorting out between the contact member 162 and adjacent wires or metal frame surfaces.

With the arrangement as shown, it will be appreciated that a quick connect has been provided between the electrical wires and the terminal block. The foil itself it quickly connected simply by placing it on the surface and locking it in place by means of the contact member. The electrical wires are then inserted with their insulation and are automatically sliced and contacted simply by closing the closure member 164 in place onto the device.

Figure 8:
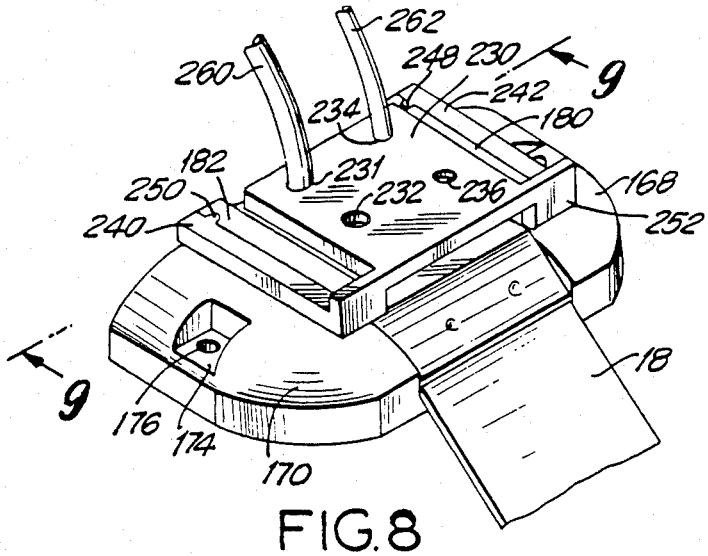
FIG. 8 is a perspective view of the embodiment shown in FIG. 7 and specifically showing an assembled condition.
Figure 9:
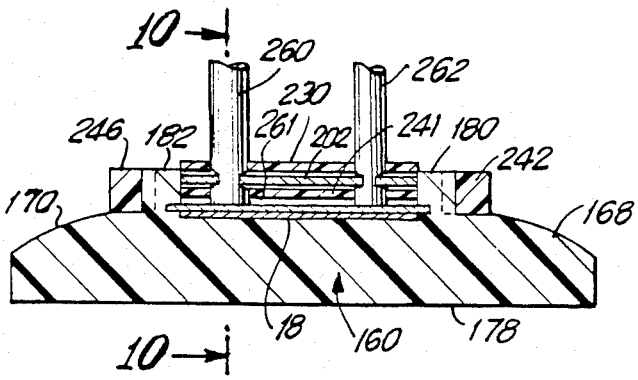
FIG. 9 is a cross sectional view taken along lines 9—9 of FIG. 8.

Once assembled, as shown in FIG. 8, an aesthetically uniform terminal block is provided which at the same time provides for good electrical connection between one or more wires and the electrical foil.

A third electrical wire connector of the magnetic reed type shown at 32 in FIG. 1, will now be described with more detail in reference to FIGS. 11–14. The magnetic reed switch itself includes a housing having an upper portion 270 and a pedestal portion 272. The pedestal portion includes a base wall 274 with a first pair of opposing support walls 276, 278 and a second pair 276', 278'.

Within the upper housing, there is provided a base portion 280 of substantially rectangular configuration with a raised central hub portion 282. On the right, channel 284 is cut out of the raised portion having a pair of opposing side walls 286, 288 and an open bottom. At the rear wall 290 closes off the back of the channel. Spaced between the side walls 286, 288 and rearwardly directed is an angular wall 292. A similar channel 284 is provided on the left side of the raised portion 282.

Figure 14:
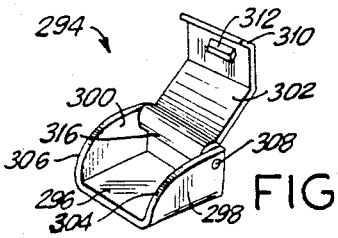
FIG. 14 is a perspective view of the metal assembly utilized as the electrical contact member of the magnetic reed switch shown in FIG. 11.

Situated within each of the channels there is provided a contact assembly shown generally at 294 and 294'. With reference now to FIGS. 11 and 14, the channel 194 is shown to include a metallic assembly having a bottom wall 296, a pair of opposing side walls 298, 300 and a hinged cover 302. The side walls include an angled forward section 304, 306 which can fit beneath the rearwardly directed connecting wall 292. The cover 302 is hinged by means of a hinge pin 308 which extends between the opposing side walls 298, 300. The cover 302 includes a downwardly angled forward portion 310 at its front end having an inwardly struck portion 312 serving as a latch. The rear end of the cover 302 is bent around the hinge pin 308 so as to form an integral barrel 314 around which the cover swings. The cover terminates at its distal end with a rearwardly angled cutting edge 316 which is downwardly directed and rearwardly facing when the cover is in its closed position. A recess 318 is provided in the angles wall 292 to receive the struck latch portion 312.

The reed switch 320 has it opposing terminals 323, 324 connected by means of soldering, or the like, to the underside of the bottom walls 296, 296' of the contact assemblies 294, 294'. The contact assemblies themselves are inserted into the respective notches 284, 284' and are held in place at their bottom by means of the support walls 276, 278 and 276' and 278'. The transverse wall 292 supports the sidewalls.

An insulated wire 322 is inserted between the bottom wall 296 and the transverse wall 292 with the cover 302 pivoted upwardly. The cover is then closed onto the wire. The slicing edge 316 slices transversely through the insulation of the wire 322 to make contact with the wire core 324 therein. The cover snaps into place with the latch 312 being received in the groove 318 on the transverse wall 292. The metal cover 302 being in contact with the contact assembly 294 which is in contact with the soldered wire 323 of the reed switch which interconnects the wire 322 with one end of the reed switch. Similarly, a second wire 322' can be similarly connected to the other metallic assembly 294'. It will therefore be appreciated, that a quick connect arrangement is provided where the wire is inserted in place and by means of closing the closure member the insulation is sliced through to make contact to the metal core. In this case, the wires are connected to the opposing ends of the magnetic switch.

A magnet 330 of standard construction can be placed adjacent to the magnetic reed switch 36 to hold the reed switch in its closed position. As shown, the magnet 330 includes a housing 322 having a shape substantially similar to that of the magnetic reed switch. Internally of the housing there is provided a magnet 334, extending from one end of the housing 332 to the other end and held in place by means of adhesives, or the like. A pair of mounting bores 336, 338 can be provided on the magnetic housing through its base 340. Alternatively, adhesive tape can be provided on the base 344.

Similarly, mounting holes 342, 344 are provided in the housing portion 280 of the magnetic reed switch which continue into aligned holes 346, 348 in the pedestal portion for mounting the magnetic reed switch. Adhesive can also be provided on the underside of the pedestal portion 272 for adhesive mounting of the magnetic reed switch portion.

Figure 15:
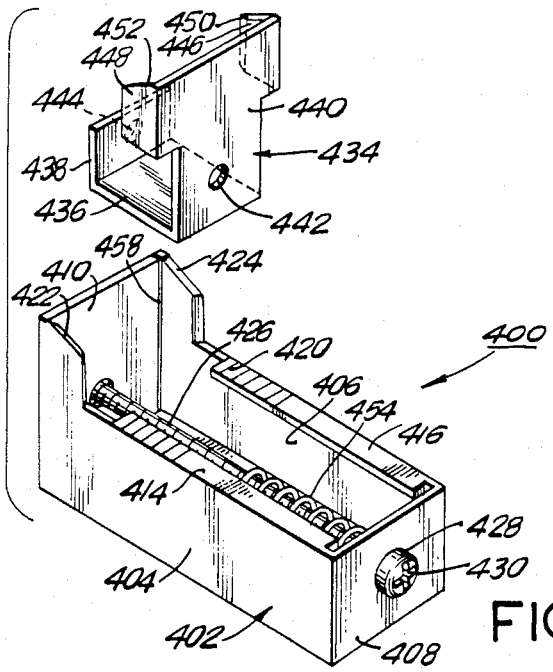
FIG. 15 is a perspective view of a slicing device in the form of a cradle which can be adjusted to provide quick connect slicing of wires having different diameters.
Figure 16:
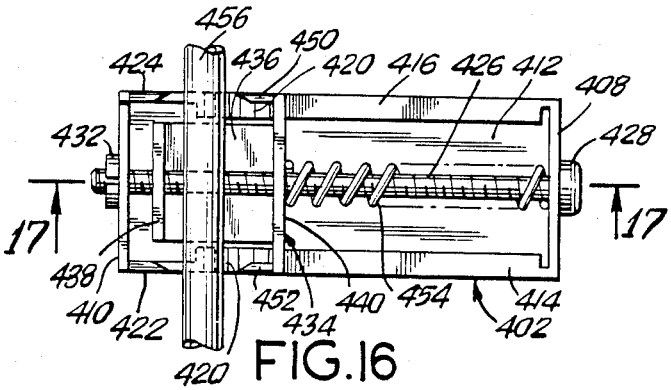
FIG. 16 is a plan view of the device shown in FIG. 15 with a wire inserted thereacross.
Figure 17:
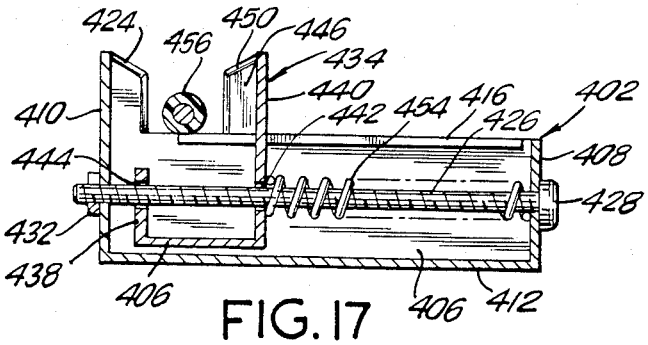
FIG. 17 is a cross sectional view taken along lines 17—17 of FIG. 16.

Referring now to FIGS. 15–17 there is shown a slicing device 400 in the form of a cradle which can be utilized to vary the slicing spacing so as to accommodate wires of different sizes. Specifically, there is provided a substantially rectangular cradle housing 402 having a pair of opposing side walls 404, 406 and opposing end walls 408, 410. The bottom is closed off with a base wall 412. However, the top portion is open. The upper edges of side walls 404, 406 terminates in inwardly turned flanges 414, 416 on which are provided a series of gauge lines 420 indicating various gauge sizes of wire. The base wall shown need not be included.

The front end wall 410 extends above the side walls and is interconnected to the side walls by means of a pair of fixed downwardly angled cutting edges 422, 424. Supported longitudinally through the cradle housing 402 is a captured screw 426 having an enlarged head 428 bearing Phillips screw head 430. At the other end, there is provided a U-shaped clamp nut 432. The enlarged head 428 is externally available on one side of the side walls 408 and the clamp 432 is secured on the other side of the wall 410.

A floating nut member 434 is free to threadably move along the screw 426. The floating nut mechanism 434 is in the form of a U-shaped member having a base wall 436 with an upwardly extending shortened front wall 438 and an upwardly extending rear wall 440. Aligned threaded apertures 442 in the rear wall 440 and 444 in the shortened front wall 438 threadably receive therethrough the screw 426.

Inwardly extending from the lateral edges of the rear wall 440 are a pair of ears 446, 448 having cutting edges 450, 452 at their upper edges. A spring 454 is provided along the screw 426 rearward of the wall 440 of the floating nut to provide a biasing force pressing the floating nut member 434 forwardly and taking up any slack that may occur in the thread.

In operation, wire 456 is placed across the cradle so as to be inserted between the fixed blades 422, 424 on the one hand and the movable blades 450, 452 on the other hand. Prior to insertion of the wire, the enlarged head 428 would be rotated so as to move the slidable nut 434 into an appropriate position to accommodate the size of the wire to be inserted. Such movement can be judged by means of the gauge lines 420 on the side flanges so as to properly place the adjustable nut in the proper position.

For example, if it is known that a particular gauge of wire is being utilized, the nut can be adjusted so that it is positioned to the corresponding gauge line scored onto the flange.

The wire is then placed in position as shown and upon a downward depression pressing the wire between the fixed and the slidable cutting edges, the insulation on the wire will be cut and the core of the wire will be contacted. The cradle can preferably be made of metal and thereby the metal cradle will contact the metal core of the wire.

The metal cradle can be stamped and then folded into the desired shape as shown. The fold line of the metal sections is shown along the line 458. Other types of construction can also be utilized.

FIG. 18 shows a type of wire connector heretofore shown in FIG. 2 wherein a male connector plug would be inserted into a female connector plug to provide a composite cylindrical housing wire connector. In the present arrangement, the slicing cradles of FIG. 15–17 are utilized to make the wire connectors of a type that can be utilized with variable wires.

More particularly, the wire connector is shown to include a base portion 500 in the form of an elongated rectangular member having an open top. A corresponding mating rectangular cover portion 502 is provided. For convenience, the cover portion is shown having a front end 504 and a rearward end 506 connected by an integral hinge 508. A separator wall 510 separates the front connecting portion 512 from the rearward receiving portion 514. Likewise in the base member 500, there is a separating wall 516 separating the front connecting portion 518 from the rearward receiving portion 520.

In the rearward receiving portion 520 of the base 500, there are provided a pair of opposing side rails 522, 524 spaced apart along one side wall 526. Along a center wall 528 there is likewise provided a pair of opposing spaced apart side rails 530, 532. A groove 534 is provided in the center wall 528 spaced between the side rails 530, 532. Likewise, a channel 536 is provided between the side walls 522, 524 and terminates in a substantially circular aperture 538.

An adjustable slicing cradle, shown generally at 540, and of the type described in FIGS. 15–17, is slidably received between the four side rails 522, 524, 526, and 528. The adjusting knob 542 will slide down the channel 536, and be received in the aperture 538 so as to extend externally of the connector and be externally adjustable to vary the slicing size thereby accommodating wires of different sizes. The locking clamp 544 with the extended portion of the screw 526 will be received within the channel 534. The slicing cradle 540 will be seated on a base support 546 at the bottom of the base member 500.

Although it will not be described, another slicing cradle 540' would be inserted in opposing relationship in a correspondingly provided receiving section on the other side of the wall 528.

Prior to insertion of the cradles, a pair of elongated tubular terminal connectors 550, 550' would be inserted in the grooves 552, 552' provided in the center wall 516. Mating corresponding grooves 554 and 554' are provided in the wall 520 in the cover portion so as to secure the contact members 550, 550' in place.

The connectors 550, 550' include tubular front portions 556, 556' which continue to extend into elongated flat portions 558, 558' and conclude in tab portions 560, 560'. The tab portions will be seated directly onto the base supports 546, 546' and it is onto these that the cradles 540 and 540' would be seated. The contacts 550, 550' would be metal.

Wires 562, 562' are inserted through opposing mating apertures 564, 564' provided in the base portion and 566, 566' provided in the cover portion. These would be inserted between fixed and variable blades of the slicing device. The rear portion 506 of the cover portion 502 contains a plurality of spaced apart depressing fingers 568, 568'. These are so arranged as to press the wires 562, 562' into the slicing blades to cut the insulation. In this way, the wires would be inserted in place in the slicing cradles. With the cover 502 placed on the base portion 500, the rear portion 506 would be folded downwardly and locked in place thereby causing the depressing fingers to have the wires sliced. The wire cores will therefore contact the metal slicing cradles which in turn are in electrical contact with the pads 560, 560' which are extensions of the electrical contacts 550, 550'.

In the arrangement there would be provided a male plug and a female receptacle. One of these would have the cylindrical portions 556, 556' in the form of tubular bullets and the others would have the portions in the form of hollow cylinders to receive the tubular bullets. In this way, the male plug would make electrical contact with the female receptacle.

In order to provide adequate closure between the cover portion 502 and the base portion 500, a side recess 568 is provided which would engage the groove 570 in the base portion. Also, locating pins 572 are received in the locating apertures 574. The portions between the cylindrical contacts 556 and the flat elongated contact portions 558 is outwardly flared at 576, 576' to fit on the inner side of the walls 510, 516 to prevent the contacts from being pulled out.

It will thereby be noted that the plug connector in FIG. 18 is now of the type that can accommodate variable sized wires with the device being suitably preadjusted in order to accommodate the size of the wires.

The same type of cradle mechanism can also be utilized in connection with the magnetic reed switch, as shown in FIG. 19. Specifically, the magnetic reed switch is shown generally at 600 and includes a flat base portion 602 which integrally continues into an upwardly extending pedestal portion 604. Within the pedestal portion are provided a pair of side receiving chambers 606, 606'. Both of these being identical, only one of these will be described. In the bottom, there is provided a base wall 608 which includes a slit 610 in which extends a wire 612 connecting to the reed switch 614 retained in the housing. The outer wall 616 includes a downward channel 618 terminating in an aperture 620 for receiving the adjusting nut provided on the slicing cradle 622. Likewise, a groove 624 is provided on the inner wall 626 to accommodate the projecting screw from the cradle 622.

In the figures shown the cradle 622' is already positioned on its receiving chamber 606' and the cradle 622 is readily inserted. These can be secured in place by adhesive should such be needed.

A cover 630 is connected by an integral hinge 632. The cover member includes depressing fingers 634, 634' so arranged to press a wire into the slicing cradle. The wire is inserted through the front wall 636 by means of U-shaped grooves 638, 638'. Appropriate locking mechanism can be provided for the cover 630 to be secured onto the pedestal portion.

It will therefore noted that in the embodiment shown in FIG. 19, a magnetic reed switch is provided which can be utilized to accommodate different sized wires with the size being adjustable before insertion of the wire.

Referring now to FIGS. 20–22, there will be shown another embodiment of the terminal block type of connector switch. The terminal block is provided with a base member 700 of insulated material. The base member includes an inner channel 702 with a pair of spaced apart side raised shoulders 704, 706. A pair of inwardly directed notches 708, 710 are provided near the rear of the shoulders 704, 706. At the front of the shoulders, there are provided locking cuts 712.

The front of the channel 702 is downwardly sloped at 714 and includes indents 716. Midway through the length of the channels 702 is provided a substantially rectangular well 718.

A closure member 720 is provided having a substantially V-shaped arrangement including a base portion 722 and a closing cover portion 724 hinged together by an integral hinge 726. The V-shaped member 720 would be formed of metallic contact material.

The base portion 722 is shaped so as to substantially conform to the channels 702 in the insulated housing portion 700. Specifically, it includes a downwardly sloped forward portion 728 having a plurality of detents 730 which can engage into the indents. Likewise, a cut out well 732 will be aligned to the well portion 718. A pair of laterally extending wings 734 are provided to fit into the grooves 708, 710. For convenience, they include pointed edges 736 to secure them in place.

The cover portion 724 is likewise provided with a front downward lip 738 having lateral wings 740. On the inside of the wings 740 there would be provided the engaging bumps 742 for engaging into the cuts 712 on the side shoulders of the housing portion. A downwardly depending cutting blade 744 is provided as can better be seen in FIG. 22. The cutting blades include upwardly extending slots 746 with a flared mouth portion 748. For convenience, there can be also provided an opening 750 rearward of the cutting blade for receiving the wires 752, 752'.

As best seen in FIG. 21, in the assembled condition, a strip of foil 754 is placed along the track 702. The metallic member 720 is placed onto the track and locks the metal foil in place. The side sections 734 with the notch portion 736 would be secured and the detents 730 would fit into the indents 716 and provide good metallic contact with the foil 754.

The wires 752, 752' could be inserted into the opening 750 provided in the closure member 724. They would be extended forward onto the base member 722. The cover would then be closed so that the slicing portion 744 would extend down through the opening 732 and into the well 718 and slice the wire 752 therebeneath. The downwardly extending lip 738 would then be pushed forward until one of the bumps 740 would fit into a side slot 712. Since there are a plurality of side slots 712, the device can accommodate different size and gauge wires. Likewise, since the mouth 748 is flared, the different size and gauge wires can be sliced.

Referring now to FIGS. 23–26, there is shown yet another embodiment of a metal foil block, similar to that previously shown in FIGS. 7 and 20. The metal foil block is shown generally at 800 and includes a base portion 803 having a pair of side raised shoulders 804, 806 with a depressed center platform 808. A pair of slightly raised side shoulders 810, 812 border the platform 808. The platform has a substantially flattened surface with a downwardly tapered forward end 814. A V-shaped transverse groove 816 is positioned across the downwardly sloped front portion 814. The lower distal edges of the side shoulders 810, 812 are undercut at 818, 820.

A vertical channel 822 is formed into the transverse wall 808, adjacent the back of the base member. A pair of spaced apart U-shaped troughs 824, 826 extend from a rear end 828 of the base member 802 and continue across the channel 822 terminating in the notches 830 and 832. These notches are the upper end of passageways 834 which actually extend into the body of the base member 802.

A metal retaining member 840 snaps onto the base member. The metal retaining member 840 has a shape conforming substantially to the platform portion of the base member. Specifically, it includes a horizontal upper portion 842 continuing into a downwardly sloped forward portion 844. A corresponding V-shaped notched portion 846 is at the forward end of the sloped portion 844. The sloped portion continues into a pair of spaced apart legs 848, 850 which end in inwardly turned feet portion 852, 854. A pair of detents 856, 858 are correspondingly positioned to engage the indents 860, 862 in the surface of the platform 808.

The back wall of the metal retaining member 840 terminates in a downwardly depending back wall 866. As best seen in FIG. 26, the back wall 866 includes a pair of spaced apart V-shaped slicing notches 868, 870. The forward end of the notches have open mouths 872, 874 to better receive the wires that will be sliced therein.

In operation, a strip of metal foil 876 is placed along the platform 808 and extending downward along the forward sloped portion thereof 814. Typically, the size of the strip of metal foil will be such as to fit inbetween the raised shoulder portions 810, 812.

One of the two wires 878, 880, are inserted into its respective trough 824, 826. The metal retaining clip 840 is then positioned on top of the base member and pressed in place. In doing so, the back wall 866 fits into the channel 822, as best shown in FIG. 25. As it moves downward, it splices the insulation on the wire, as shown in FIG. 26, making contact between the metal retaining member 840 and a core 882, or 884 of the wire. At the same time, the front two feet 852, 854, lock under the undercuts 818, 820 to lock the member in place. The metal retaining member makes contact with the foil 876. By means of the engagement between the detents 856, 858 and the indents 860, 862, a better contact with the foil will be insured.

In this manner, as best shown in FIG. 25, an electrical contact will be made between the metal foil 876 and one of the electrical wires 880.

By means of the two troughs 824, 826, instead of interconnecting a metal foil with an electrical wire, two electrical wires can actually be interconnected. The two wires 878, 880 would both be placed in position and no metal foil would be inserted. With the metal regaining member positioned in place, the insulation on the two electrical wires would be sliced, thereby making electrical contact between the two wires. Of course, should both wires want to be connected in parallel to the metal foil, wires can be used together with the metal foil.

FIG. 27–29 show another embodiment of a plug connector, similar to the plug connector shown in FIGS. 2 and 18. In this case, however, the plug is of the type known as a hermaphrodite plug wherein the same plug can be used as both the male and female type connector by interconnecting identical ones of the plugs in inverted relationship.

As shown in FIG. 27, a first plug 900 is shown interconnected with a second plug 902. Since both plugs are identical, only plug 900 will be identified. Where portions of plug 902 are required for identification, they will be identified with the addition of a "prime" added to the indicating number.

Referring to plug 900, it is shown that the plug consists of a substantially U-shaped base portion 904 having connected to it a cover member 906 interconnected by means of a hinge 908. The back end of the base portion is open while the cover portion includes a top wall 908 and a rear wall 910.

The base portion includes a pair of spaced apart receptacle sections 912, 914 separated by a median wall 916. In each of the receptacle sections, there is provided a contact member 918. Both the contact members are substantially identical. The contact member includes a base wall 920 which extends along substantially the length of the receptacle in which it is placed. At the forward end of the contact, the contact turns upwardly along a vertical wall 922 and then continues into a substantially horizontal prong section 924. The distal end of the prong section is angles at 926. Spaced along the substantial length of the contact are a first pair of upright prongs 928, 930 whose upper ends are outwardly tapered to form a mouth 932. The prongs are spaced apart to define a pair of adjacent cutting edges 934, 936. A second pair of substantially identical prongs 938 is spaced from the first pair of prongs. Both of these prong sections are struck upwardly from the base portion 920. A pair of openings 940, 942 are positioned forward and aft of the prong sections.

It should be noted that in the right hand receptacle section 912, defined as the male section, the contact member 918 is moved more forward in the receptacle portion than is the contact member 918 in its section 914 defined as the female section. Likewise, the male section 912 has its bottom wall slightly raised above the bottom wall of the female section 914. Because the contact member 918 in the male receptacle section 912 is moved forward, its front prong will also project more forward than that of the female section 914.

In the front wall 944 of the base portion are provided a pair of spaced apart slots 946 in the female section, and 948 in the male section. In this way, the prong 924 from the contact 918 in the male section extends into its slit 948 to project forward of the plug. On the other hand, the plug 924 of the contact 918 in the female section 914 extends just inwardly of its slit 946.

Likewise because the bottom wall of the male section 912 is raised, the prong 948 extends into the slit 948 and specifically adjacent its upper edge. On the other hand, prong 924 of the contact 918 of the female section 114, being on a lower level, will be positioned just at the bottom of its slit 945.

With reference to the cover member 906, its back wall 910 has a pair of spaced apart apertures 950, 952 for receiving a pair of wires, one of which is shown at 958. Inwardly of the aperture 952, is a passageway defined by a pair of large blocks 960 and 962, spaced apart by a pair of smaller blocks 964, 968 and terminating in a front wall 970. Circular apertures are formed in the larger blocks 960 and 962, which can be seen as the aperture 972. The aperture forms a trough 974 in the smaller blocks 964, 968.

Likewise, extending from the aperture 950, there is provided a single large block 974 with a pair of troughs 978 on either side thereof and again terminating in a front wall 980. Likewise, an aperture 982 would be formed in the larger block which continues as a trough 984 in the smaller block.

In operation, a pair of wires would be inserted into the apertures 950, 952 at the back wall 910 of the cover 906. The wires would be inserted until they respectively hit the front walls 970, 980. The wires would then be securely held in place in the troughs and apertures provided in the large and small blocks in the inside of the cover member.

With the wires held in place, the cover would be depressed onto the base portion. In doing so, the troughs would serve as a depressing member for pressing the wires downwardly into the respective members provided on the contacts therebelow. The slicing members would slice through the insulation of the wires and contact the metal core at the interior of the wires. The cover would be held in place by means of the locking detents and indents 990, 992, on the sides of the cover and base portions. A suitable shoulder 994 is provided along the sides of the base portion to permit the cover to fit snugly onto the base portion.

The cut wires are best seen in FIG. 28 which shows the pair of wires secured in place in the respective male and female receptacles, each of them being sliced by the respective slicing means and retained snugly in place by the closure of the cover onto the base portion.

As best seen in FIG. 29, one of these plugs can be inverted and inserted within the other plug. In this way, the male prong 924 of one plug will extend into the corresponding slit 946′ of the other adjacent plug 902 and will overlie and be in contact with the female prong 924′ of the adjacent plug. Since the female prong is at a slightly lower level than the male prong, the male prong will be able to enter above the female prong and overlie it in contact therewith. In this way, contact will be made between the wire 958 and a wire 958′. The wires being spliced so their metal cores 996, 996′ are in contact through the engaging prongs.

To retain the metal contact in place, upstanding studs 998 can be projecting upward from the base wall and engage the corresponding apertures provided in the bottom of the contact members.

Referring now to FIGS. 30 and 31, there is shown another embodiment of a magnetic reed switch, similar to the type shown in FIGS. 11 and 19. The magnetic reed switch shown generally at 1000 comprises a base housing 1002, shown as a substantially U-shaped portion including opposing side walls 1004, and 1006 and a base wall 1007. The opposing ends are open. Positioned within the housing, and transverse thereacross parallel to the open ends, are a pair of substantially identical U-shaped clip assemblies 1008 and 1008′, only one of which will be described. The U-shaped clip includes one wall 1010 retained in place by a pair of triangular support members 1012 and 1014. The opposing leg 1016 faces the leg 1010 and terminates in a narrow neck portion 1018 continuing into a bent head portion 1020 having a pair of spaced apart legs with a V-shaped slicing means in between thereof, 1022 as best shown in FIG. 31. A slit 1024 formed adjacent the distal end of the leg 1010 can receive the slicing legs therein when the two legs are pressed together. The two legs are interconnected by a bight portion 1026 which is retained in place by means of a securing block 1028.

In this manner, the U-shaped clip is held in place with the leg 1016 being free and capable of being depressed so that the slicing legs 1022 can enter into the slit 1024.

An aperture 1030 is formed in the front wall 1002 of the base member and is aligned so as to extend between the two legs. A wire 1032 is capable of being inserted into the aperture and placed between the two legs.

A closure block 1034 can snugly close off one of the open ends. A correspondingly identical block 1036 is provided for the other ends. The closure block includes a hingable tang 1038 having a downwardly extending ridge 1040. A slit 1042 separates the tang 1038 from the rest of the block 1034. Such tang 1034 with its depending lip 1040 is very similar to the standard tang at the end of a telephone interconnector.

A pair of adjacent slots 1044, 1047 are formed in to the base wall 1007 of the bottom portion. The lip 1040 is engageable into the two slots 1044, 1046 depending upon how far the plug 1034 is inserted into the end.

On initially being assembled, a magnetic reed member 1050 is interconnected electrically by means of the wires 1052, 1054 to the two outer walls 1010 of the U-shaped clip members. The two clip members are then inserted in place on the base portion as shown in FIG. 30. A cover 1060 is then secured in top of the walls 1004 and 1006. The outer plugs 1034 and 1036 are then inserted in place so that the lip 1040 engages the outermost slot 1044. In this position, while the two ends will be closed, the spring clip legs will be not be closed together.

When it is desired to use the magnetic reed switch, electrical wires would be inserted into the apertures. The wires would be inserted far enough until they hit the block 1028 which also forms a stop for insertion of the wires. The wire is inserted with its insulation. The two end plugs 1034, 1036 are then depressed until the lip 1040 engages the innermost slot 1046. Such continued pressing of the plug members will serve to move the outer leg 1016 of the clip member until its slicing arms enter into the slit 1024. In doing so, it will slice the insulation on the wire and make contact with the core of the wire thereby interconnecting the core of the wire to the magnetic switch between the two clips and completing an electrical circuit through the magnetic reed switch.

It should be understood that although the foregoing connectors were described in connection with burglar alarm systems, that the similar type of connectors could be provided with loudspeakers or other electrical systems. Furthermore, although three particular types of electric wire connectors were described, other types of electrical connectors could be provided having a similar type of arrangement for slicing of the insulation in order to provide a quick connect arrangement.

There has been disclosed heretofore the best embodiments of the invention presently contemplated. However, it is to be understood that various changes and modifications made be made thereto without departing from the spirit of the invention.

I claim:

1. An electrical terminal block, comprising a base portion having a receiving platform for receiving a layer of metal foil material at least along a portion thereof, at least one wire receiving trough formed thereacross, and a channel formed into said base portion transverse to said trough, a metal retaining member having one wall section for engaging foil material placed on the platform and another wall section, at least one elongated notch formed into said another wall section from a free end thereof, defining an opposing pair of cutting edges, said another wall section aligned with said channel, whereupon insertion of an insulated electrical wire into said trough, and with the placement of said metal retaining member onto said base portion, whereupon said another wall section enters the channel, said wire and said elongated notch are forced into engagement to slice the insulation and contact the wire core to electrically interconnect the wire core to a foil material, and further comprising clip means between said metal retaining members and said base portion for retaining the metal retaining member secured on to said base portion.

2. An electrical terminal block as in claim 1, comprising a pair of said troughs formed in spaced relationship along said platform, said channel being transverse to both said troughs and comprising a pair of said notches respectively aligned with said troughs, whereupon placement of said metal retaining member onto said base portion with wires respectively in both said troughs serves to electrically interconnect said wires.

3. An electrical terminal block as in claim 2, wherein a forward end of said trough is embedded into said base portion beneath said platform, and forward of said channel.

* * * * *